US007779564B2

(12) United States Patent
Valiyambath Krishnan et al.

(10) Patent No.: US 7,779,564 B2
(45) Date of Patent: Aug. 24, 2010

(54) BOILER SYSTEM FOR USE WITH A STEAMING DEVICE

(75) Inventors: Mohankumar Valiyambath Krishnan, Singapore (SG); Swee Loon Michael Tang, Singapore (SG); Choon Hwee Tan, Singapore (SG); Mong Hua Tua, Singapore (SG); Derrick Wai Thong Loke, Singapore (SG); Kok Wah Ma, Singapore (SG); Chandra Mohan Janakiraman, Singapore (SG)

(73) Assignee: Koninklijke Philips Electronics N.V., Eindhoven (NL)

( * ) Notice: Subject to any disclaimer, the term of this patent is extended or adjusted under 35 U.S.C. 154(b) by 197 days.

(21) Appl. No.: 11/995,389

(22) PCT Filed: Jul. 6, 2006

(86) PCT No.: PCT/IB2006/052273

§ 371 (c)(1),
(2), (4) Date: Jan. 11, 2008

(87) PCT Pub. No.: WO2007/007241

PCT Pub. Date: Jan. 18, 2007

(65) Prior Publication Data

US 2008/0189992 A1 Aug. 14, 2008

(30) Foreign Application Priority Data

Jul. 11, 2005 (EP) ..... 05106296

(51) Int. Cl.
*D06F 75/12* (2006.01)
*D06F 75/10* (2006.01)

(52) U.S. Cl. ..... 38/77.6

(58) Field of Classification Search ..... 38/74, 38/77.6, 77.7, 77.81, 79; 219/246, 250; 68/222
See application file for complete search history.

(56) References Cited

U.S. PATENT DOCUMENTS

| | | | | |
|---|---|---|---|---|
| 1,399,175 A | | 12/1921 | White | |
| 3,869,816 A | * | 3/1975 | Busby | 38/77.83 |
| 4,017,988 A | | 4/1977 | Coggiola | |
| 4,881,493 A | * | 11/1989 | Riba | 392/400 |

(Continued)

FOREIGN PATENT DOCUMENTS

| | | |
|---|---|---|
| DE | 7714036 | 8/1977 |

(Continued)

*Primary Examiner*—Ismael Izaguirre

(57) ABSTRACT

A steam ironing system (2) comprises a steam iron (10) and a boiler system (25) having a boiler (30) for generating steam, wherein the steam iron (10) and the boiler (30) are connected to each other through a steam hose (35). During operation of the boiler system (25), scale is formed in the boiler (30). For the purpose of removing the scale from the boiler (30), a rinsing process is performed on the boiler system (25) at regular intervals. During the rinsing process, a rinse valve (38) connected to a water outlet (37) positioned at a bottom of the boiler (30) is opened, and water is discharged from the boiler (30) to a rinse container (55). In the process, scale particles are carried along with the flow of water. Preferably, pressure is built up inside the boiler (30) prior to opening the rinse valve (38), so that the water is forcibly ejected from the boiler (30), whereby the effectiveness of the rinsing process is enhanced.

21 Claims, 2 Drawing Sheets

U.S. PATENT DOCUMENTS

Figure 1:
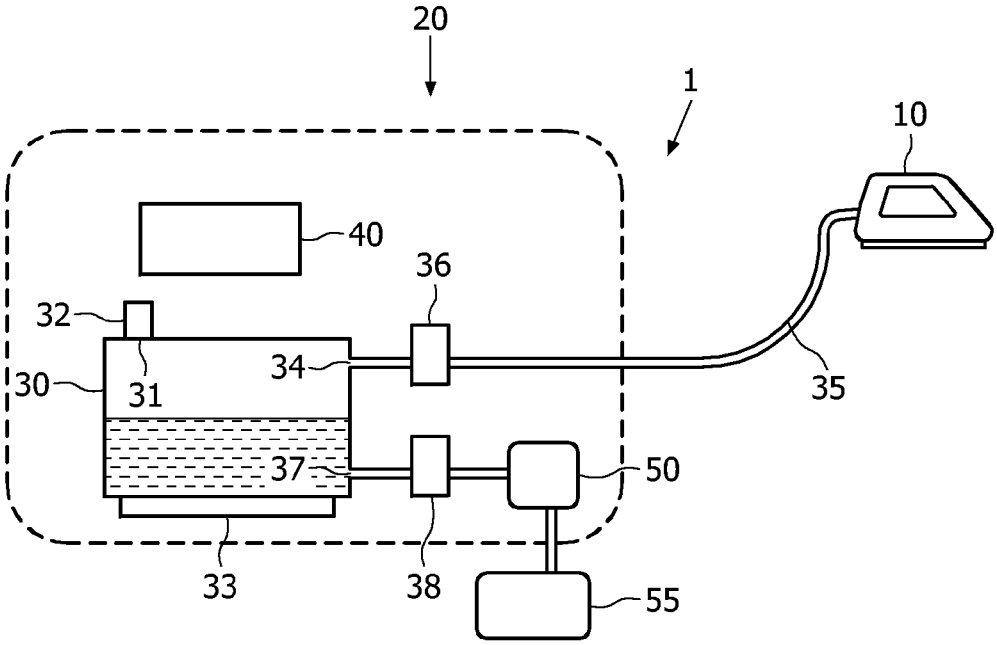

| | | | | |
|---|---|---|---|---|
| 5,315,773 | A * | 5/1994 | Iwami et al. | 38/77.6 |
| 5,511,950 | A * | 4/1996 | Agata | 417/36 |
| 5,567,313 | A * | 10/1996 | Almeida | 210/108 |
| 5,832,639 | A * | 11/1998 | Muncan | 38/77.6 |
| 5,841,826 | A * | 11/1998 | Rootham et al. | 376/316 |
| 5,842,295 | A | 12/1998 | Ching | |
| 5,885,364 | A | 3/1999 | Hieatt | |
| 6,833,032 | B1 * | 12/2004 | Douglas et al. | 134/3 |
| 2003/0136032 | A1 | 7/2003 | Leung | |
| 2003/0136434 | A1 * | 7/2003 | Giovalle et al. | 134/166 R |
| 2005/0061352 | A1 * | 3/2005 | Yao | 132/225 |

FOREIGN PATENT DOCUMENTS

| | | |
|---|---|---|
| DE | 20017279 | 1/2001 |
| DE | 10234625 | 2/2004 |
| EP | 0383327 | 8/1990 |
| EP | 0483622 | 5/1992 |
| EP | 1166698 | 1/2002 |
| EP | 1319743 | 6/2003 |
| EP | 1386598 | 2/2004 |
| EP | 1430823 | 6/2004 |
| JP | 59090000 | 5/1984 |
| JP | 02195995 | 8/1990 |
| JP | 10253006 | 9/1998 |
| JP | 11090097 | 6/1999 |
| WO | 9800596 | 1/1998 |
| WO | 0017439 | 3/2000 |
| WO | 03027580 | 4/2003 |

* cited by examiner

BOILER SYSTEM FOR USE WITH A STEAMING DEVICE

The present invention relates to a boiler system for use with a steaming device such as a steam iron, comprising: a boiler for containing water and heating water to steam, comprising at least one inlet for letting in water and at least one outlet for letting out steam; a steam hose connected to a steam outlet of the boiler, which is suitable to be applied for connecting the boiler to the steaming device and for conducting steam from the boiler to the steaming device during operation of the boiler system; and a steam valve connected to the steam outlet of the boiler.

Such a boiler system is well-known in practice, and is designed to be used in combination with a steam iron, for example, wherein a connection between the boiler system and the steam iron is realized through a steam hose. An important function of the boiler system is generating steam and supplying the steam to the steam iron, wherein the steam iron comprises a soleplate and steam outlets arranged in the soleplate for letting out steam to objects to be ironed. During operation of the boiler system, the steam is generated in the boiler, and a supply of steam to the steam iron is controlled by means of a steam valve connected to a steam outlet of the boiler. In many boiler systems, for the purpose of supplying water to the boiler and pressurizing the water inside the boiler, a pump is arranged.

For sake of completeness, it is noted that the term "valve" is used to indicate a device of which a condition can be adjusted. In an opened condition, the valve is capable of letting pass a flow of a fluid or a mixture of fluids. In a closed condition, the valve blocks such a flow.

During operation of the boiler system, water is supplied to the boiler and heated there, as a consequence of which scale is formed in the boiler. This scale formation causes problems, as it may occur that scale particles are displaced from the boiler to the steam iron, and land on an object to be ironed, causing stains on this object. Furthermore, over time, the water in the boiler gradually gets contaminated with ions. This phenomenon is caused by the fact that during operation of the arrangement, only water is evaporated, while most of the other components which are present in the water stay behind. In a boiler containing contaminated water, a foaming effect occurs during heating of the water, which disturbs a continuous supply of steam by the boiler, and which may cause the boiler to supply hot water along with the steam.

If the scale is not periodically removed from the boiler, the water inlet and the steam outlet clog up, as a result of which the performance of the boiler system decreases, and, eventually, the boiler system is not fit to be used any more.

According to the state of the art, in view of the above-sketched problem of the water inlet and the steam outlet of the boiler clogging up as a consequence of scale formation, a boiler system having a drainage hole and a cap for manual rinsing of the boiler is provided. When performing a rinsing process on such a known boiler system, a user needs to tilt and/or turn the boiler, and to shake the boiler in order to obtain acceptable cleaning results. In case the boiler is attached to an ironing board, the user is not capable of tilting and/or turning the boiler without detaching the boiler from the ironing board first. In order to guarantee the user's safety, the rinsing process may only be performed when the boiler is cold and at a pressure that is near ambient pressure.

It is an objective of the present invention to provide a new boiler system, wherein it is possible to have a rinsing process performed under all circumstances, without jeopardizing the safety of a user. Furthermore, it is an objective of the present invention to provide a new boiler system, wherein a rinsing process of the boiler does not require any handling of the boiler by the user.

The objective is achieved by means of a boiler system for use with a steaming device, comprising: a boiler for containing water and heating water to steam, comprising at least one inlet for letting in water, at least one outlet for letting out steam, and at least one outlet for letting out water; a steam hose connected to a steam outlet of the boiler, which is suitable to be applied for connecting the boiler to the steaming device and for conducting steam from the boiler to the steaming device during operation of the boiler system; a steam valve connected to the steam outlet of the boiler; and a rinse valve connected to a water outlet of the boiler.

According to the present invention, the boiler of the boiler system does not only comprise an outlet for releasing steam, but also comprises an outlet for draining water. A rinse valve, which is opened for the purpose of a rinsing process of the boiler, is connected to this outlet. During normal operation of the boiler system, the rinse valve is kept closed. Preferably, the water outlet is positioned at a bottom of the boiler, so that it is possible to drain practically all of the water from the boiler. The rinse valve may be positioned at the bottom of the boiler as well. In a first preferred way of rinsing the boiler system, the rinse valve is opened while the boiler is in a cold state, while the steam valve and the water inlet of the boiler are kept closed. In the process, the water is allowed to flow from the boiler, through the rinse valve, mainly under the influence of gravity. After a specified period of time, or when the water stops flowing, one of the steam valve and the water inlet of the boiler is opened, so that air is let into the boiler, and the outgoing flow of water continues until the boiler is completely empty. In this way, effective removal of scale particles and possibly other contaminants from the boiler is realized.

It is noted that the above-described first preferred way of rinsing the boiler system is particularly suitable in case the boiler system does not comprise a pump for pressurizing the water inside the boiler. In case the boiler system comprises such a pump, it is an advantageous option to operate this pump during a rinsing process. According to a second preferred way of rinsing the boiler system, which is suitable to be applied when the boiler system comprises a pump, water is pumped into the boiler for a specified period of time, or until a predetermined pressure is reached inside the boiler. Subsequently, the rinse valve is opened. As a consequence, a jet of water is discharged through the rinse valve, which carries along with it scale particles and possibly other contaminants from the boiler. Due to the pressure in the boiler, any scale that blocks the water outlet of the boiler is broken up. After the boiler has been emptied, the rinse valve is closed again. A first round of rinsing may be followed by a second round of rinsing in order to obtain cleaner water in the boiler. In this case, in principle, the rinse valve can have any position, while it is preferred to have the water outlet to which the rinse valve is connected positioned at a low point in the boiler in order to ensure that practically all of the water in the boiler is flushed out.

According to a third preferred way of rinsing the boiler, the rinsing process involves a supply of power for the purpose of heating up the boiler. The heating helps in stirring up the scale particles in the water. When a predetermined pressure is reached, the rinse valve is opened. The effect is comparable to the effect as described in respect of the second preferred way of rinsing the boiler. After the boiler has been emptied, the rinse valve is closed again. Also, when the boiler is rinsed in this third preferred way, a first round of rinsing may be followed by a second round of rinsing in order to obtain cleaner water in the boiler. Furthermore, in a boiler system which is adapted to letting a rinsing process of the boiler take place according to this third preferred way, the rinse valve can have any position, while it is preferred to have the water outlet to which the rinse valve is connected positioned at a low point in the boiler in order to ensure that practically all of the water in the boiler is flushed out.

Preferably, during the rinsing process or at the end of the rinsing process, scale solvent is introduced into the boiler. Under the influence of the scale solvent, the scale is kept in solution, and scale flakes are reduced. As an advantageous result, the efficiency of the rinsing process is improved.

In the rinsing process, it may happen that one or more small scale particles end up on a seat of the rinse valve. Advantageously, towards the end of the water discharge which takes place during the rinsing process, the rinse valve is rapidly opened and closed for a number of times in order to dislodge such scale particles. In this way, leakage of the rinse valve during operation of the boiler, which may occur in case complete closure of the rinse valve is hindered by scale particles, is prevented.

In a preferred embodiment, the boiler system according to the present invention comprises a rinse container for receiving water from the boiler and containing the water, which rinse container is removably arranged at an outlet side of the rinse valve. When a boiler system having a rinse container is subjected to a rinsing process, the water that is used in the process is received in the rinse container and remains inside the container until a user removes the container from the boiler system and pours away this water. An advantage of the application of the rinse container is that there is no need for positioning the outlet side of the rinse valve or a discharge member connected to the outlet side of the rinse valve above a separate container or a sink or the like when the rinsing process is carried out.

Advantageously, the boiler system comprises a flow smoothener, which is arranged at an outlet side of the rinse valve. An important function of the flow smoothener is prevention of splashing of the water. Consequently, when a flow smoothener is applied, the safety is enhanced, especially in case the boiler system does not comprise a rinse container. Alternatively, a device, which may be in the form of a tube of predetermined cross-sectional area and length, may be used to smoothen the flow (close to laminar flow) and to prevent splashing at the outlet side of the rinse valve. Furthermore, it is advantageous to have a filter arranged at an inlet side of the rinse valve, so that clogging up of the inlet side of the rinse valve by scale particles does not occur.

Within the scope of the present invention, for the purpose of controlling the various steps to be taken during a rinsing process, the boiler system may be provided with a suitable controller, for example a microcontroller or a memory IC. It is possible that a rinsing process is initiated on the basis of input of a user, wherein the boiler system may comprise a push button or the like for receiving input from the user and communicating this input to the controller. However, it is also possible that the rinsing process is automatically initiated after a specific duration of operation of the boiler system. For example, the rinsing process is initiated at every interval of ten hours of steaming, i.e. ten hours of the steam valve being opened. In such a case, the boiler system comprises measuring means for measuring a length of time of an opened condition of the steam valve, and the controller is adapted to keeping record of a total length of time of the opened condition of the steam valve, to comparing the total length of time of the opened condition of the steam valve to the maximum length of time of ten hours, and to operating the rinsing process in case the total length of time of the opened condition of the steam valve has reached the maximum length of time of ten hours. This is an accurate manner of determining the time when a rinsing process should be performed.

Within the scope of the present invention, it is possible that the boiler comprises more than one steam outlet. In such a case, it is advantageous if the sum of cumulative times of opening of all of the steam valves is taken into account in the process of determining an appropriate moment for a rinsing process to take place.

Another method for determining an appropriate moment for triggering a rinsing process, which is applicable in boiler systems comprising a pump for supplying water to the boiler, comprises the steps of determining the total time of operation of the pump, and comparing the total time to a maximum time.

It is also possible to apply an indirect method of determining the moment at which a rinsing process may be initiated. For example, the number of times the boiler system is operated is counted, and the rinsing process is initiated when the total number of times of operation has reached a predetermined maximum number. In particular, the boiler system may comprise detecting means for detecting operation of the boiler, wherein the controller is adapted to keeping record of a total number of times of operation, to comparing the total number of times of operation to a maximum number of times, and to operating the rinsing process in case the total number of times of operation has reached the maximum number of times.

In order to achieve a greater accuracy when the above-described indirect method is applied, the temperature of the boiler or the steaming device is measured at various positions. As scale builds up inside the boiler, it acts like a thermal barrier, as a result of which the temperature distribution is disturbed. Thus, by measuring the temperature at various positions, it is possible to find out if the temperature distribution is still within normal limits, or not. In the latter case, an indication that the rinsing process should be performed is obtained. In view of the foregoing, in a preferred embodiment in which the boiler system according to the present invention is adapted to determining a suitable moment for initiating a rinsing process, measuring means for measuring a temperature at various positions in the boiler or the steaming device are provided, and the controller is adapted to calculating differences between the measured temperatures and a predetermined temperature, to comparing the calculated temperature differences to a maximum difference, and to operating the rinsing process in case the calculated temperature differences have reached the maximum difference.

In a preferred embodiment, the boiler system according to the present invention comprises indicator means for providing feedback to a user in respect of a rinsing process of the boiler. In particular, the indicator means may be controlled by the controller such as to indicate that a rinsing process is in progress, or that a rinsing process has been completed. The indicator means may be of any nature, and may for example be mechanical, electrical, electronic or electromechanical. Furthermore, the indicator means may be adapted to providing feedback to the user in any suitable way, for example by providing an audible signal or a visible signal.

The present invention also relates to a steam ironing system, comprising a boiler system according to the present invention and a steam iron or a garment steamer, wherein the boiler system and the steam iron or the garment steamer are connected to each other through the steam hose of the boiler system. Furthermore, the present invention relates to an active ironing board comprising a steam supplying arrangement and a boiler system according to the present invention, wherein the steam supplying arrangement and the boiler system are connected to each other through the steam hose of the boiler system.

Figure 2:
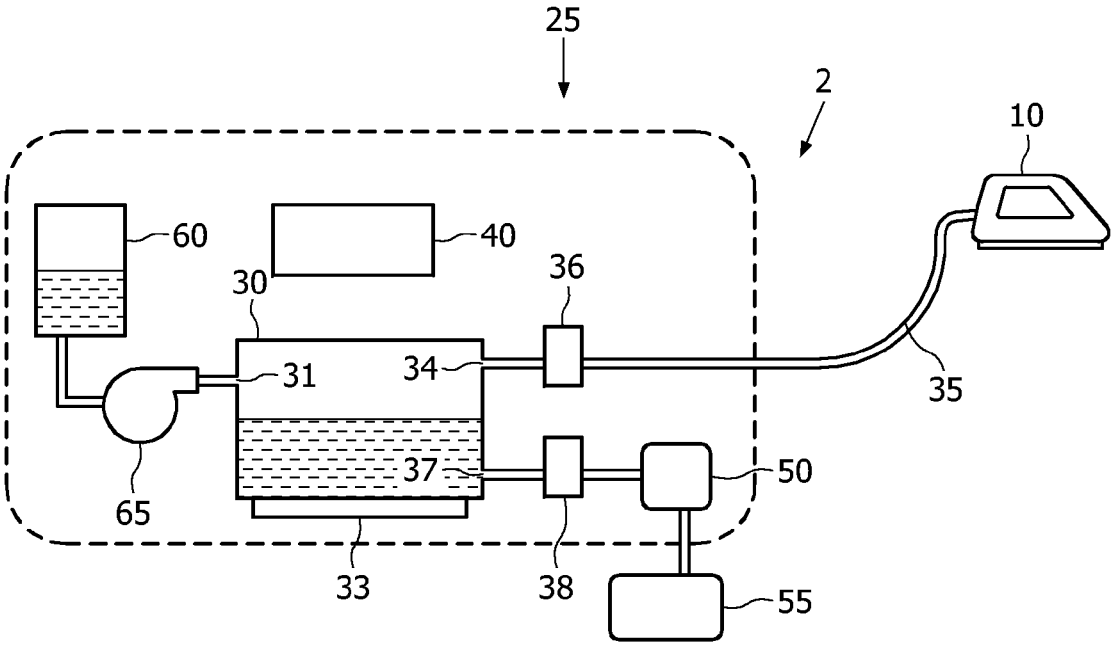
Figure 3:
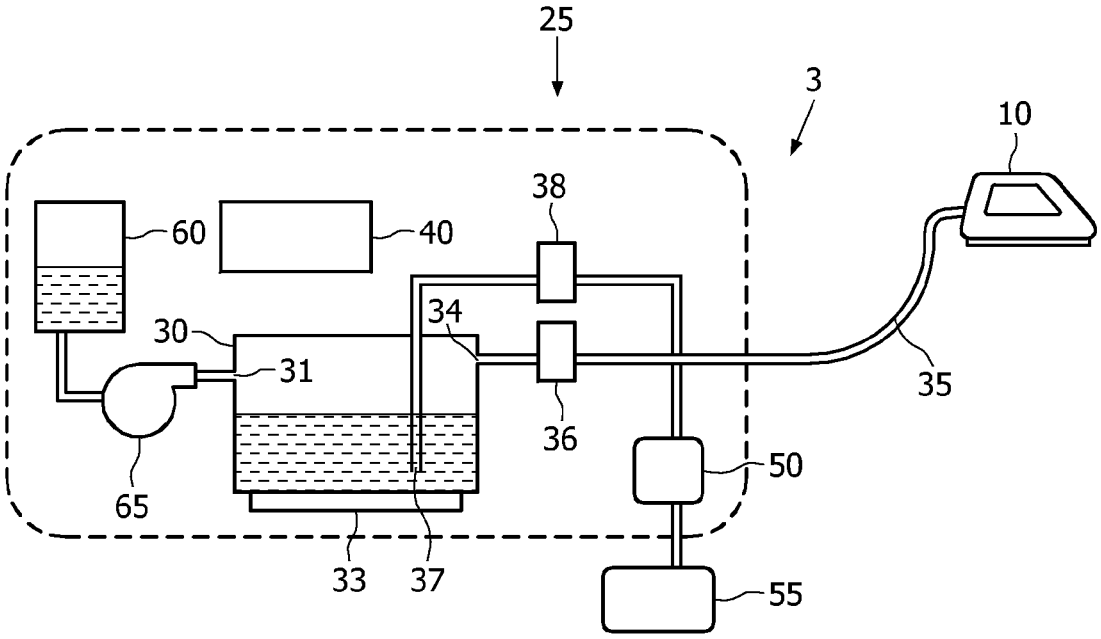

The present invention will now be explained in greater detail with reference to the figures, in which similar parts are indicated by the same reference signs, and in which:

FIG. 1 diagrammatically shows a steam ironing system comprising a steam iron and a boiler system according to a first preferred embodiment of the present invention;

FIG. 2 diagrammatically shows a steam ironing system comprising a steam iron and a boiler system according to a second preferred embodiment of the present invention; and FIG. 3 diagrammatically shows a steam ironing system comprising a steam iron and a boiler system according to a third preferred embodiment of the present invention.

FIG. 1 diagrammatically shows a steam ironing system 1 comprising a steam iron 10 and a boiler system 20 according to a first preferred embodiment of the present invention.

The boiler system 20 comprises a boiler 30 for containing water and heating water to steam. In FIG. 1, a quantity of water such as may be present inside the boiler 30 is diagrammatically depicted as a collection of water droplets. For the purpose of receiving water, the boiler 30 comprises a water inlet 31. At the position of this water inlet 31, a water filling cap 32 is arranged. At a bottom of the boiler 30, a heating element 33 is arranged. During operation of the boiler system 20, the heating element 33 is activated, as a result of which the water inside the boiler 30 is heated and steam is generated.

On demand of a user, the steam that is generated in the boiler 30 is supplied to the steam iron 10, so that the steam may be applied during a steam ironing process which is performed with the help of the steam iron 10. The boiler 30 comprises a steam outlet 34 for letting out steam, and the steam iron 10 is connected to the boiler 30 through a steam hose 35 and a steam valve 36 which is arranged at the steam outlet 34. When the user desires to have steam supplied from the boiler 30 to the steam iron 10, the steam valve 36 is put to an opened condition, in which the steam valve 36 is capable of letting pass a flow of steam. When there is no need for a supply of steam from the boiler 30 to the steam iron 10, the steam valve 36 is put to a closed condition, in which the steam valve 36 blocks the steam outlet 34 of the boiler 30.

The boiler system 20 comprises a controller 40 such as a microcontroller or a memory IC for controlling the condition of the steam valve 36. Preferably, the steam iron 10 comprises means which are operable by a user for the purpose of communicating to the controller 40 a desire to have a supply of steam. However, that does not alter the fact that in principle, such means may also be arranged at another position.

During operation of the boiler 30, scale is formed inside the boiler 30, mainly as a deposit on inner sides of walls of the boiler 30. The formation of the scale deposit has many disadvantageous consequences. For example, scale particles may break lose during operation of the boiler 30 and be carried along with the steam to the steam iron 10. Such scale particles are spit out by the steam iron 10 and land on the object which is subjected to a steam ironing process, as a result of which this object gets stained. Also, the presence of scale inside the boiler 30 reduces the effectiveness of the heating process of the water inside the boiler 30, so that the process of putting water to steam takes more time and energy.

Furthermore, over time, the water inside the boiler 30 gets contaminated, as a result of which a foaming effect occurs during heating of the water, which disturbs a continuous supply of steam by the boiler 30, and which may cause the boiler 30 to let out hot water along with the steam through the steam outlet 34.

In view of the above-sketched problems, it is desirable to have means which are applicable for the purpose of removing water and scale from the boiler 30. In the boiler system 20 as shown in FIG. 1, such means comprise a water outlet 37 of the boiler 30, which is arranged near a bottom of the boiler 30, and a rinse valve 38 which is arranged at the water outlet 37. Furthermore, the boiler system 20 comprises a flow smoothener 50 and a rinse container 55.

Due to the presence of the water outlet 37 and the rinse valve 38, it is possible to have a rinsing process performed in the boiler system 20. In particular, in the boiler system 20, the rinsing process is carried out prior to the start of a steam ironing session. During the rinsing process, the rinse valve 38 is opened, so that water is drained from the boiler 30, through the water outlet 37 and the rinse valve 38, mainly under the influence of gravity. After a specified period of time, or when the water stops flowing, the steam valve 36 or the water filling cap 32 is opened, so that air is let into the boiler 30, and the outgoing flow of water continues until the boiler 30 is completely empty. In this way, effective removal of scale particles and possibly other contaminants from the boiler 30 is realized. Preferably, in order to avoid clogging up of the water outlet 37 by scale particles, a filter (not shown) is arranged at the water outlet 37.

The water that is drained from the boiler 30 flows through the flow smoothener 50, and is eventually received in the rinse container 55. As a result of the presence of the flow smoothener 50, turbulence of the outgoing flow of water is reduced, and splashing of the water is prevented. The rinse container 55 is removably arranged, so that it is convenient for a user of the steam ironing system 1 to empty the rinse container 55, as the user may simply take the rinse container 55, carry it to a sink or the like, empty it, and put the empty rinse container 55 back in place again. Preferably, suitable indicating means are provided for indicating to the user that the rinse container 55 is full and needs emptying. At the end of the rinsing process, the rinse valve 38 is closed again, and the steam ironing system 1 is fit to be used in a steam ironing session.

The boiler system 20 may comprise means which may be operated by a user for the purpose of communicating to the controller 40 a need for starting a rinsing process. However, it is preferred if the rinsing process is started automatically, after a predetermined duration of usage of the steam ironing system 1, wherein the controller 40 is programmed such as to automatically start a rinsing process when a detected duration of usage appears to have reached the predetermined duration of usage.

For example, the controller 40 is adapted to keeping record of the number of times a power supply to the boiler system 20 has taken place, and comparing a total number of times to a predetermined number of times. In case the total number of times appears to have reached the predetermined number of times, it is time for the rinsing process to be carried out, and the rinsing process is started by the controller 40, prior to the start of a steam ironing session. For greater accuracy, it is advantageous if not only the number of times of operation is taken into account. Preferably, temperature measurements are performed as well, at various positions in the boiler 30 or the steam iron 10. As scale builds up inside the boiler 30, it acts as a thermal barrier. When a deviant temperature is found during the temperature measurements, an indication that the rinsing process needs to be carried out is obtained.

It is also possible that the controller 40 is adapted to keeping record of a total time of an opened condition of the steam valve 36. In such a case, the need for starting a rinsing process is determined in a highly accurate manner, as the total time of the opened condition of the steam valve 36 is directly related to the total amount of generated steam and the total amount of scale. Also, in this case, the total time of the opened condition is compared to a predetermined total time by the controller 40, and the rinsing process is started in case the total time as measured appears to have reached the predetermined total time.

Advantageously, in case the controller 40 of the boiler system 20 is not adapted to automatically starting the rinsing process, the boiler system 20 comprises indicating means for indicating to a user a need of having a rinsing process carried out.

The boiler system 20 may also be used in combination with another steaming device than a steam iron 10. For example, the boiler system 20 may be mounted in an active ironing board having a steam supplying arrangement. Usually, such an ironing board comprises an ironing surface for supporting objects to be ironed, and is adapted to performing at least one of the functions of blowing air or drawing in air through the ironing surface, and may also comprise at least one heating element for heating the ironing surface.

FIG. 2 diagrammatically shows a steam ironing system 2 comprising a steam iron 10 and a boiler system 25 according to a second preferred embodiment of the present invention.

The boiler system 25 according to the second preferred embodiment of the present invention resembles the above-described boiler system 20 according to the first preferred embodiment of the present invention to a considerable extent. An important difference is that the boiler system 25 according to the second preferred embodiment of the present invention comprises an arrangement of a water tank 60 and a pump 65 for the purpose of filling the boiler 30 with water, whereas the boiler system 20 according to the first preferred embodiment of the present invention comprises the water filling cap 32. Hence, when the boiler system 25 according to the second preferred embodiment of the present invention is applied, there is no need for a user to pour water in the boiler 30 when the boiler 30 needs to be filled. There is only a need for the user to pour water in the water tank 60, in case the water tank 60 is empty or almost empty. In a manner known per se, indicating means may be provided for indicating to the user that the water tank 60 needs filling. In FIG. 2, quantities of water such as may be present inside the boiler 30 and inside the water tank 60 are diagrammatically depicted as a collection of water droplets.

The way in which the steam ironing system 2 as shown in FIG. 2 is operated during a steam ironing session is essentially similar to the way in which the steam ironing system 1 as shown in FIG. 1 is operated: the water in the boiler 30 is heated so that steam is generated, and the steam is supplied to the steam iron 10 through the steam valve 36 and the steam hose 35. When, during operation of the steam ironing system 2, there is no need for a supply of steam to the steam iron 10, the steam valve 36 is closed.

Like the boiler system 20 as shown in FIG. 1, in view of the possibility of carrying out a rinsing process of the boiler 30, the boiler system 25 as shown in FIG. 2 comprises a water outlet 37 of the boiler 30, which is arranged near the bottom of the boiler 30, a rinse valve 38 which is arranged at the water outlet 37, a flow smoothener 50 and a rinse container 55. The process of determining an appropriate moment for carrying out the rinsing process may also be performed in ways as already described in relation to the boiler system 20 according to the first preferred embodiment of the present invention. However, the rinsing process may be performed in a different manner, for example in one of the manners as will be explained below.

According to a first possibility, the rinsing process is performed prior to the start of a steam ironing session. When the rinsing process is initiated, the pump 65 is activated to pump water into the boiler 30 during a specified period of time, or until a predetermined pressure is reached inside the boiler 30. Subsequently, the rinse valve 38 is opened. As a consequence, the water is forcibly ejected from the boiler 30, wherein a jet of water is obtained, which carries along with it scale particles and possibly other contaminants from the boiler 30. Due to the pressure in the boiler 30, any scale that blocks the water outlet 37 of the boiler is broken up. To increase the efficiency of the rinsing process, the pump 65 could continue its operation or be restarted during the time the rinse valve 38 is opened, wherein the flow of water is enhanced, and wherein flushing of the boiler 30 is improved. After the boiler 30 has been emptied, the rinse valve 38 is closed again. A first round of rinsing may be followed by a second round of rinsing in order to obtain cleaner water in the boiler 30.

According to a second possibility, the boiler 30 is heated by means of the heating element 33. The heating helps in stirring up the scale particles in the water. When a predetermined pressure is reached, the rinse valve 38 is opened. The effect is comparable to the effect as described in respect of the first possibility. After the boiler 30 has been emptied, the rinse valve 38 is closed again. Also, when the boiler 30 is rinsed in this way, a first round of rinsing may be followed by a second round of rinsing in order to obtain cleaner water in the boiler 30.

The predetermined pressure may be reached in the boiler 30 by heating the water to steam, wherein it is not necessary that the pump 65 is also activated. However, it is also possible that the pressurizing effects of heating the water and operating the pump 65 are combined. In principle, a rinsing process comprising the successive steps of heating the water and opening the rinse valve 38 may also be performed on the boiler system 20 according to the first preferred embodiment of the present invention.

In all possible configurations of the boiler system 20, 25 according to the present invention, rinsing of the boiler 30 takes place in an effective manner. Moreover, due to the fact that the boiler system 20, 25 comprises a boiler 30 having water outlet 37 and a rinse valve 38 connected to the water outlet 37, safe and hassle-free rinsing of the boiler 30 is provided at any time.

It will be clear to a person skilled in the art that the scope of the present invention is not limited to the examples discussed in the foregoing, but that several amendments and modifications thereof are possible without deviating from the scope of the present invention as defined in the attached claims.

It is not necessary for the rinse valve 38 to be positioned at the water outlet 37 of the boiler 30, especially in case of the steam ironing system 2 according to the second preferred embodiment of the present invention, as this embodiment of the steam ironing system comprises a pump 65. In stead, the rinse valve 38 may have any position, wherein it is preferred that the water outlet 37 is positioned at a low point in the boiler 30 in order to ensure that practically all of the water is flushed out during a rinsing process. By way of illustration, a steam ironing system 3 according to a third preferred embodiment of the present invention is shown in FIG. 3, which resembles the steam ironing system 2 according to the second preferred embodiment of the present invention to a large extent, with this difference that in the steam ironing system 3 as shown in FIG. 3, the rinse valve 38 is not arranged at the water outlet 37, but is positioned at a higher level.

For sake of completeness, it is noted that the flow smoothener 50 and the rinse container 55 do not constitute essential components of the boiler system 20, 25 according to the present invention.

In the foregoing, a steam ironing system 1, 2, 3 comprising a steam iron 10 and a boiler system 20, 25 is disclosed. The boiler system 20, 25 has a boiler 30 for generating steam, and the steam iron 10 and the boiler 30 are connected to each other through a steam hose 35. During operation of the boiler system 20, 25, scale is formed in the boiler 30. For the purpose of removing the scale from the boiler 30, a rinsing process is performed on the boiler system 20, 25 at regular intervals. During the rinsing process, a rinse valve 38 connected to a water outlet 37 positioned at a bottom of the boiler 30 is opened, and water is discharged from the boiler 30 to a rinse container 55. In the process, scale particles are carried along with the flow of water. Preferably, pressure is built up inside the boiler 30 prior to opening the rinse valve 38, so that the water is forcibly ejected from the boiler 30, whereby the effectiveness of the rinsing process is enhanced.

The invention claimed is:

1. Boiler system for use with a steaming device, comprising:

a boiler for containing water and heating water to steam, comprising at least one inlet for letting in water, at least one outlet for letting out steam, and at least one outlet for letting out water;

a steam hose connected to a steam outlet of the boiler, which is suitable to be applied for connecting the boiler to the steaming device and for conducting steam from the boiler to the steaming device during operation of the boiler system;

a steam valve connected to the steam outlet of the boiler; and a rinse valve connected to a water outlet of the boiler, wherein the boiler system is configured to be rinsed by the successive steps of opening the rinse valve while keeping the steam valve and the water inlet of the boiler closed, and opening one of the steam valve and the water inlet of the boiler.

2. Boiler system according to claim 1, wherein the water outlet is positioned at a bottom of the boiler.

3. Boiler system according to claim 1, wherein the water outlet and the rinse valve are positioned at a bottom of the boiler.

4. Boiler system according to claim 1, further comprising a rinse container for receiving water from the boiler and containing the water, which rinse container is removably arranged at an outlet side of the rinse valve.

5. Boiler system according to claim 1, further comprising a flow smoothener arranged at an outlet side of the rinse valve.

6. Boiler system according to claim 5, wherein the flow smoothener comprises a tube of a predetermined cross-sectional area and length.

7. Boiler system according to claim 1, further comprising a filter arranged at an inlet side of the rinse valve.

8. Boiler system according to any of claim 1, further comprising a pump for supplying water to the boiler and for pressurizing the water inside the boiler.

9. Boiler system according to claim 1, further comprising a controller adapted to operating a rinsing process comprising the step of opening the rinse valve on the basis of an indication of a need to drain water from the boiler.

10. Boiler system according to claim 9, further comprising detecting means for detecting operation of the boiler, wherein the controller is adapted to keeping record of a total number of times of operation, to comparing the total number of times of operation to a maximum number of times, and to operating the rinsing process in case the total number of times of operation has reached the maximum number of times.

11. Boiler system according to claim 10, further comprising measuring means for measuring a temperature at various positions in the boiler or the steaming device, wherein the controller is adapted to calculating differences between the measured temperatures and a predetermined temperature, to comparing the calculated temperature differences to a maximum difference, and to operating the rinsing process in case the calculated temperature differences have reached the maximum difference.

12. Boiler system according to claim 9, further comprising measuring means for measuring a length of time of an opened condition of the steam valve, wherein the controller is adapted to keeping record of a total length of time of the opened condition of the steam valve, to comparing the total length of time of the opened condition of the steam valve to a maximum length of time, and to operating the rinsing process in case the total length of time of the opened condition of the steam valve has reached the maximum length of time.

13. Boiler system according to claim 1, further comprising indicator means for providing feedback to a user in respect of a rinsing process of the boiler.

14. Steam ironing system, comprising a boiler system according to claim 1 and a steam iron, wherein the boiler system and the steam iron are connected to each other through the steam hose of the boiler system.

15. Steam ironing system, comprising a boiler system according to claim 1 and a garment steamer, wherein the boiler system and the garment steamer are connected to each other through the steam hose of the boiler system.

16. Active ironing board comprising a steam supplying arrangement and a boiler system according to claim 1, wherein the steam supplying arrangement and the boiler system are connected to each other through the steam hose of the boiler system.

17. Boiler system for use with a steaming device, comprising:

a boiler for containing water and heating water to steam, comprising at least one inlet for letting in water, at least one outlet for letting out steam, and at least one outlet for letting out water;

a steam hose connected to a steam outlet of the boiler, which is suitable to be applied for connecting the boiler to the steaming device and for conducting steam from the boiler to the steaming device during operation of the boiler system;

a steam valve connected to the steam outlet of the boiler; and a rinse valve connected to a water outlet of the boiler, wherein the boiler system is configured to be rinsed by the successive steps of pressurizing water in the boiler by heating this water, and opening the rinse valve.

18. Method for rinsing a boiler system according to claim 9, wherein the boiler system further comprises a pump for supplying water to the boiler and for pressurizing the water inside the boiler, the method comprising the successive steps of pressurizing water in the boiler by operating the pump, and opening the rinse valve.

19. Rinsing method according to claim 18, further comprising the step of heating the water in the boiler.

20. Boiler system according to claim 1, wherein the rinsing method further comprises the step of introducing scale solvents into the boiler.

21. Boiler system according to claim 1, wherein the rinsing method further comprises a sequence of opening and closing the rinse valve in quick succession for a number of times.

* * * * *